United States Patent [19]

Tolleson

[11] 4,002,236

[45] Jan. 11, 1977

[54] SURVIVAL KIT COMPRISING COLLAPSIBLE CROSS-BOW

[76] Inventor: Gary L. Tolleson, 25418 Outlook Drive, Carmel, Calif. 93921

[22] Filed: Sept. 22, 1975

[21] Appl. No.: 615,288

[52] U.S. Cl. ..... 206/577; 124/31; 135/66; 206/803; 206/315 R; 206/31; 206/579

[51] Int. Cl.[2] ..... F41C 19/00; A45B 9/06; A63D 55/00

[58] Field of Search ..... 206/803, 223, 315, 317; 124/31, 30 R; 135/47

[56] References Cited

UNITED STATES PATENTS

| | | | |
|---|---|---|---|
| 1,283,015 | 10/1918 | Yung | 135/47 |
| 3,269,380 | 8/1966 | Stevens | 124/30 R |
| 3,283,717 | 11/1966 | Balch | 206/803 |
| 3,387,698 | 6/1968 | Hendricks et al. | 206/223 |

FOREIGN PATENTS OR APPLICATIONS

| | | | |
|---|---|---|---|
| 43,791 | 10/1908 | Switzerland | 124/25 |

OTHER PUBLICATIONS

"Playthings," Nov. 1958, p. 79.

*Primary Examiner*—William Price
*Assistant Examiner*—Douglas B. Farrow
*Attorney, Agent, or Firm*—Phillips, Moore, Weissenberger, Lempio & Strabala

[57] ABSTRACT

A survival kit is disclosed which is based on a hollow tubular member which serves both as the main body of a collapsible cross-bow and as a container for the component parts of the cross-bow and other survival equipment. The preferred embodiment of the elements of the collapsible cross-bow are described and a preferred trigger mechanism for the cross-bow is disclosed.

10 Claims, 6 Drawing Figures

SURVIVAL KIT COMPRISING COLLAPSIBLE CROSS-BOW

BACKGROUND OF THE INVENTION

This invention relates to survival kits of the type in which various implements essential to survival in the wilderness including a weapon for the defense of the user or for killing small game are packaged in a water-tight container and more particularly to a survival kit in which the water-tight container serves as an integral part of the defensive weapon.

Survival kits for pilots, shipwreck victims and other persons likely to find themselves abandoned in the wilderness without the support of civilization are known in the art. Such survival kits usually include fish line, hooks, knives, a small supply of medicines, and emergency food rations, in which case the survival kit may be made light enough for extended transport by hand and buoyant enough to float in the event of an accident over water. However, attempts in the prior art to include a weapon capable of inflicting injury at a distance for the defense of the user or for the killing of small game have resulted in survival kits which are bulky and unwieldy particularly where they are designed for buoyancy in water and the weapon included has generally been of limited usefulness. For example, survival kits including a pistol together with a limited amount of ammunition have been proposed. However, if the pistol is of large enough caliber to be effective as a weapon of defense or in killing small game, then it together with a reasonable amount of ammunition will be sufficiently heavy to make the design of a survival kit buoyant in water difficult, if not impossible. If the weapon is of small enough caliber, then its weight together with the weight of a reasonable supply of ammunition is compatible with a buoyant survival kit, but the effectiveness of the weapon in terms of defense and the killing of small game will be reduced. In any event only a limited amount of ammunition can be included in a survival kit and after the expenditure of such ammunition, the weapon will be useless.

It is a principal object of this invention to provide a survival kit which includes a weapon capable of inflicting injury at a distance and that is buoyant in water and capable of transport for extended distance by hand.

It is another object of this invention to provide a collapsible cross-bow.

It is a further object of this invention to provide a collapsible cross-bow the main body of which provides a container for the structural elements thereof when disassembled.

It is yet another object of this invention to provide an improved trigger mechanism for a cross-bow.

SUMMARY OF THE INVENTION

A survival kit and cross-bow according to the teaching of this invention comprises an elongated hollow tubular body closed at one end by a solid plug. A cap removably seals the other end of the hollow tubular body water-tight to provide a sealed container of given length. A pair of resilient arms of equal length less than the given length of the sealed container are each mounted at one end on the solid plug at the end of the elongated hollow tubular body with the arms extending normally to the axis of the hollow tubular body in a common plane on opposite sides thereof. A bowstring having its opposite ends each removably mounted under tension at the free end of a different one of the pair of resilient arms is provided together with a trigger mechanism removably mounted on the exterior of the hollow tubular body at a point spaced along the body from the resilient arms in a plane normal to the plane thereof which releasably holds the bowstring under tension with the resilient arms flexed. Thus the resilient arms, bowstring and trigger mechanism may be removed from the elongated hollow body and received within the sealed container, provided by such body and the cap, together with other implements of survival.

BRIEF DESCRIPTION OF THE DRAWING

The foregoing and other objects and features of this invention will be more fully understood from the drawing which shows a preferred embodiment thereof and the following detailed description of the drawing wherein.

DETAILED DESCRIPTION OF PREFERRED EMBODIMENT

Figures 1, 2:
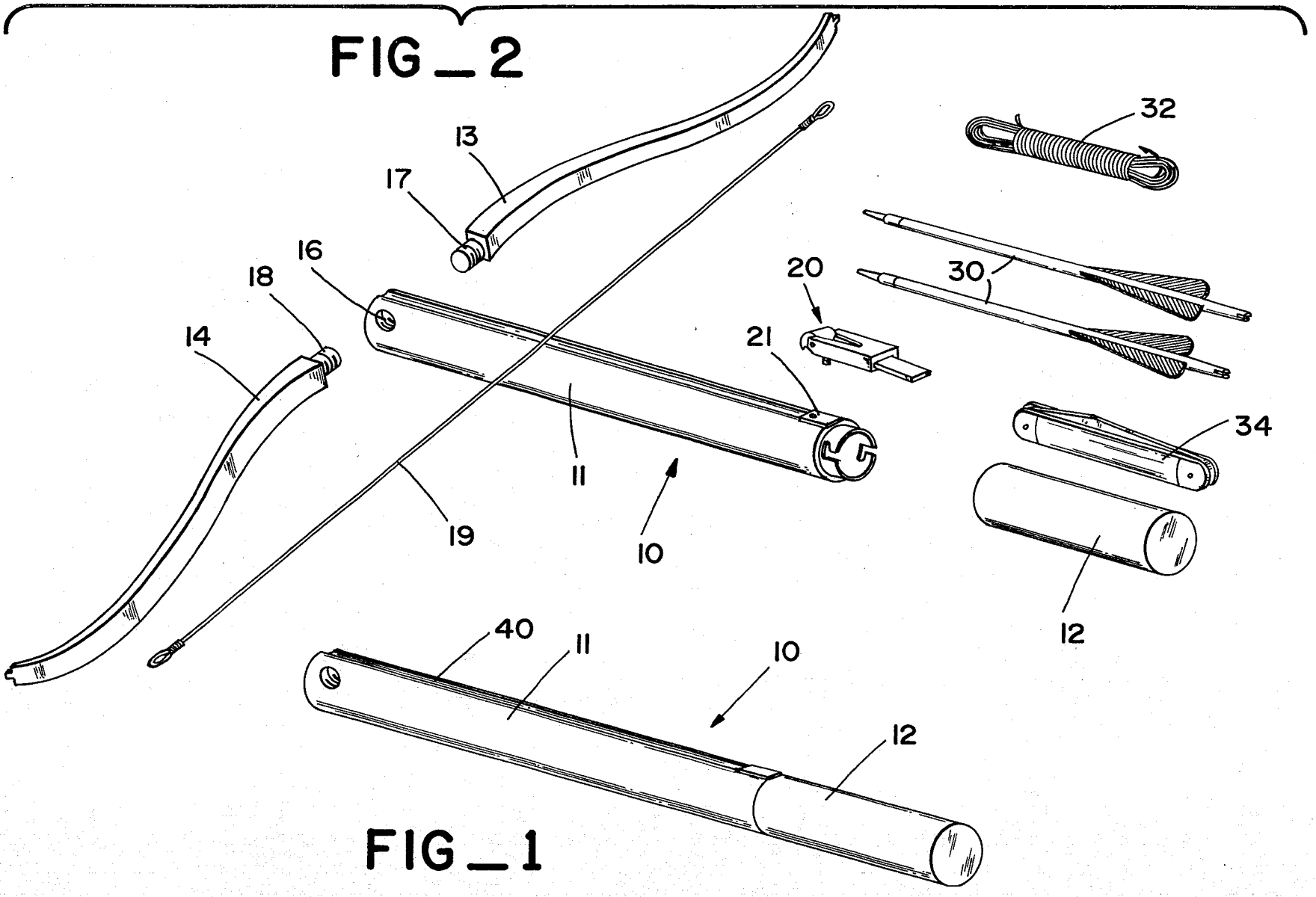
FIG. 1 is a perspective view of the survival kit according to the preferred embodiment of this invention as fully disassembled and packed for transport.
FIG. 2 is an exploded perspective view of the FIG. 1 embodiment of this invention showing the essential elements of the collapsible cross-bow together with other implements of survival which may be included in the survival kit.
Figure 3:
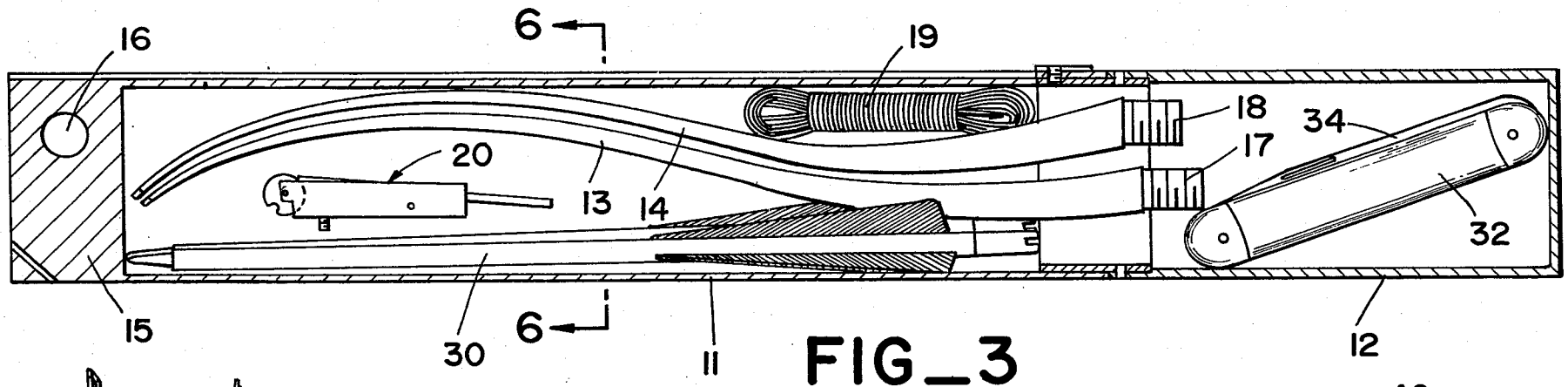
FIG. 3 is a cross-sectional view of the FIG. 1 embodiment as fully packed for transport with essential and optional elements contained therein shown in full.

Referring to FIG. 1, a preferred embodiment 10 of the survival kit according to the teaching of this invention as fully packed for transport comprises essentially an elongated right circular cylinder consisting of an elongated body 11 and a cap 12. As best shown in FIGS. 2 and 3, the elongated body 11 is hollow and means are provided to enable it to be removably sealed water-tight by the cap 12 as by means of the bayonet interconnection therebetween and the resilient gasket as shown in FIGS. 2 and 3. It will be understood that other appropriate removable interconnection means between the elongated body 11 and cap 12 such as screw threads with or without a gasket member could be used so long as they provide a water-tight seal.

Referring to FIG. 2, it will be seen that a survival kit according to the teaching of this invention includes a pair of elongated resilient arms 13 and 14 together with means for removably mounting one end of each of such arms 13, 14 rigidly with respect to the elongated body 11 at the end thereof remote from the cap 12. Thus, as best shown in FIG. 3, the end of the elongated body 11 remote from the cap 12 is closed by a solid plug 15 which is preferably integral with the elongated body 11. The solid plug 15 is provided with a threaded aperture 16 which extends therethrough with the axis of threaded aperture 16 perpendicular to the axis of the elongated body 11 and with the aperture 16 spaced from the axis of the elongated body 11 on one side thereof.

The resilient arms 13 and 14 are each provided with a threaded stud 17 and 18 at one end thereof dimensioned to threadedly engage the threaded aperture 16 from opposite ends thereof. The thread of aperture 16 is continuous therethrough and the studs 17 and 18 and resilient arms 13 and 14 are identical to each other thereby enabling them to be interchangeable with each other in their engagement with the aperture 16.

The survival kit according to the teaching of this invention also includes a bowstring 19 adapted to have its opposite ends each removably mounted under tension at the free end of a different one of the pair of resilient arms 13 and 14. Thus, as shown in FIG. 2, the bowstring 19 may be provided with loops at its opposite ends and the free ends of the resilient arms 13 and 14 may be provided with appropriate notches or other means for receiving the loops at the ends of the bowstring 19.

As also shown in FIG. 2, a survival kit according to the teaching of this invention includes a trigger mechanism 20 together with appropriate means for removably mounting the trigger mechanism 20 on the exterior of the elongated body 11 which may include a mounting plate 21, as will be more fully described hereinafter. In addition, one or more arrows 30 together with other implements of survival may be included in the survival kit. For example, a fishing line and hooks 32 and folding knife 34 may be included in the kit together with emergency medical supplies and emergency rations or other survival implements normally included in a survival kit. To this end, the cap 12 may be an elongated hollow extension of the main body 11 of the kit in order to provide additional storage space but more importantly an elongated cap 12, as shown in the drawing, will provide a handle for more convenient utilization of the cross-bow as shown in FIG. 4.

Figure 4:
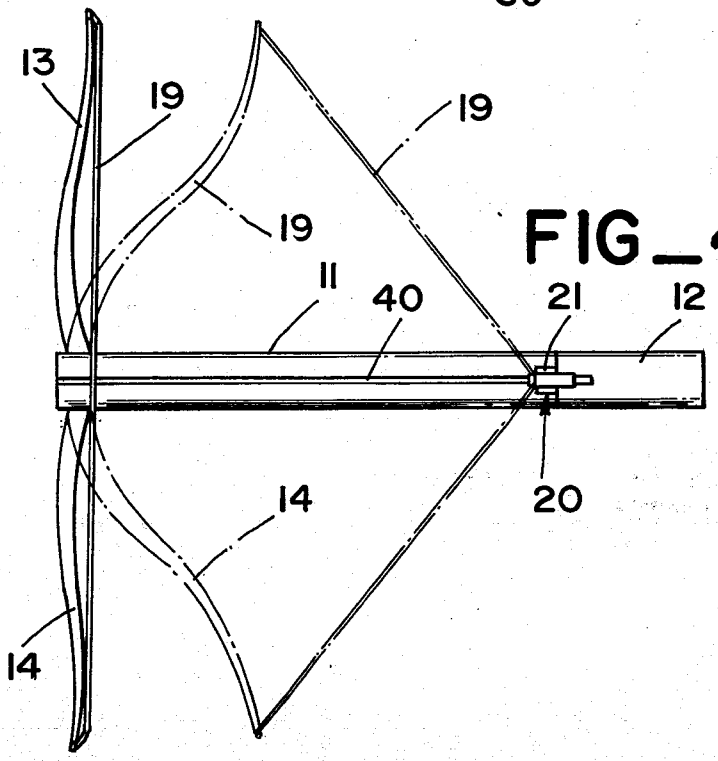
FIG. 4 is a top plan view of the FIG. 1 embodiment of this invention with the essential elements of the collapsible cross-bow shown in their fully assembled position in full and with the cocked position of the elements of the cross-bow shown in dotted lines.

Referring to FIG. 4, a top plan view of the survival kit is shown as fully assembled for use. The cocked position of the resilient arms 13 and 14 with the bowstring 19 received in the trigger mechanism 20 is shown in dotted lines. It will be seen that the trigger mechanism 20 is mounted on the exterior of the elongated body 11 at the end thereof adjacent the cap 12 and in a plane perpendicular to the plane in which the resilient arms 13 and 14 extend. Thus the cross-bow provided by the survival kit may be cocked and held by the handle provided by the elongated cap 12 for aiming and firing in a manner similar to either a pistol or a rifle.

Figure 5:
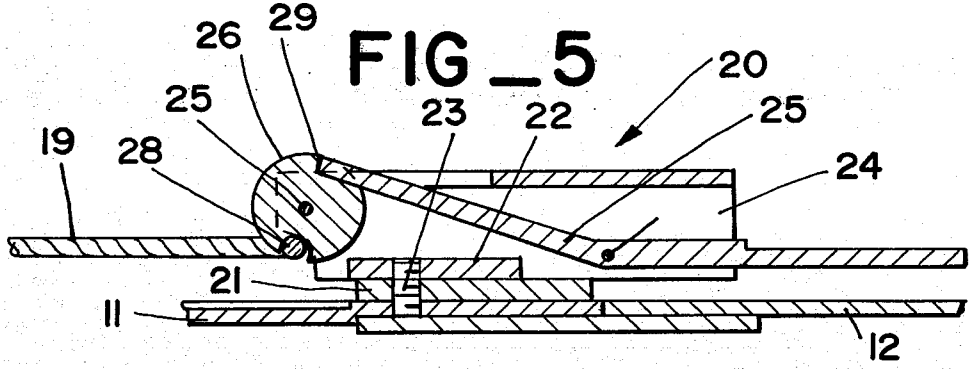
FIG. 5 is an enlarged cross-sectional view of the trigger mechanism of the FIG. 1 embodiment of this invention.

Referring to FIG. 5, an enlarged cross-sectional view of the trigger mechanism 20 in accordance with this embodiment of the invention is shown. Such trigger mechanism 20 is of the rolling block type and comprises a mounting bracket having a flat bottom 22 provided with a threaded stud 23 for engagement with a mating threaded aperture in the mounting plate 21. The mounting bracket includes upstanding walls 24 (only one of which is shown in FIG. 5) between which a pair of spaced pins 25 extend to provide axles for the mounting of the rolling block 26 and of trigger lever 27. The rolling block 26 is a short solid cylinder mounted for rotation about its axis on the axle provided by the pin 25 at one end of the bracket and is provided with a pair of diametrically opposed notches 28 and 29 for receiving the bowstring 19 and one end of the trigger lever 27, respectively. The trigger lever 27 is mounted between its ends for pivotal movement about the axle provided by the second pin 25 at the other end of the bracket so that the one end thereof may be moved into and out of locking engagement with the notch 29 of the rolling block 26 by the application of force to the other end of the trigger lever 27.

Thus, as shown in FIG. 5, when the bowstring 19 is received within the notch 28, it will urge the rolling block 26 to rotate about the pin 25 in a clockwise direction. When the end of the trigger lever 27 is received in the notch 29, it will prevent clockwise rotation of the rolling block 26 and hold the cross-bow in its cocked position as indicated by the dotted lines in FIG. 4. The application of force to the other end of the trigger lever 27 tending to produce rotation of the trigger lever 27 in a clockwise direction as shown in FIG. 5 will remove the end of the trigger lever 27 from blocking engagement with the notch 29 in the rolling block 26 allowing the rolling block 26 to rotate in a counterclockwise direction and release the bowstring 19. From the above, it will be seen that a simple and effective trigger mechanism is provided having a minimum of working parts subject to wear or damage by the elements.

Figure 6:
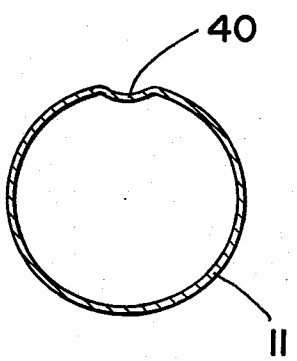
FIG. 6 is a cross-sectional view taken along line 6—6 of FIG. 3 with the elements packed within the survival kit omitted for clarity.

Referring to FIG. 6 it will be seen that an indented channel 40 is formed in the elongated body 11. As best shown in FIGS. 1, 2 and 4, such channel 40 extends from adjacent the mounting plate 21 for the trigger mechanism 20 to the end of the elongated body 11 and thus provides a guide for the arrow 30 or bolt to be shot from the cross-bow. It should be emphasized that although one or more feathered arrows 30 or bolts may be included in the survival kit, it would be possible for a user to fashion suitable missiles or bolts to be fired by the cross-bow in the wilderness. The feathers, of course, provide greater stability in flight but effective bolts for a cross-bow may be fashioned without feathers from any relatively straight stick of appropriate diameter. The channel 40 may be made somewhat deeper than shown in the drawing in order to facilitate the launching of makeshift missiles or bolts from the cross-bow according to the teaching of this invention. Thus, an inexhaustible supply of ammunition may be fabricated for the cross-bow in most wilderness situations at least for relatively short distance defense and killing of small game.

According to the preferred embodiment of this invention the elongated body 11, cap 12, resilient arms 13 and 14 and trigger mechanism 20 are fabricated of aluminum. Thus, the survival kit will be relatively light in order to provide for buoyancy in water and to facilitate the long distance transportation of the survival kit by hand or on the person of the user. Although the exact dimensions of the survival kit are subject to variation, it has been found that an elongated body 11 made of aluminum tubing approximately 1½ inches (4 cm) in diameter and 11 inches (28 cm) long having a solid plug 15 at one end about 1¼ inches (3 cm) long provides a suitable basic building block for a survival kit according to the teaching of this invention. The cap 12 may be a 5 inch (12 cm) length of similar aluminum tubing closed at one end in order to provide a convenient handle for the assembled cross-bow as well as additional storage space within the survival kit. The resilient arms 13 and 14 are made of tempered aluminum and each has a total length less than the total length of the hollow container provided by the body 11 and cap 12. In the preferred embodiment of this invention the arm 13 and 14 each have a length approximately equal to the length of the elongated body 11.

It is believed that those skilled in the art will make survival kits according to the teaching of this invention differing in certain respects from the embodiment shown in the drawing. Obviously, changes in dimensions and dimensional relationships are possible. However, it must be remembered that in order to be useful, the cross-bow must be capable of being cocked by the average user of the survival kit who will often be in a weakened condition. At the same time, the cross-bow must be powerful enough to be effective at a reasonable distance. In the dimensions described hereinabove, the cross-bow may be cocked by placing the feet on the arms 13 and 14 adjacent the body 21 and pulling with the hands on the bowstring 19 while manipulating the rolling block and trigger mechanism with the thumb without requiring undue effort on the part of the user. The use of a larger diameter aluminum tubing for the body 11 and cap 12 will enable a larger quantity and variety of survival implements to be included in the kit, however too large a diameter will make the cross-bow unwieldy in use and the kit unwieldy to transport.

What is claimed is:

1. A survival kit comprising an elongated hollow tubular body of circular cross-section closed at one end by a solid plug, a cap removably sealing the other end of said hollow tubular body water-tight to provide a sealed container of given length, a pair of resilient arms of equal length less than said given length of said sealed container, means removably mounting one end of each of said pair of arms in said solid plug at said one end of said elongated hollow tubular body with said arms extending normally to the axis of said hollow tubular body in a common plane on opposite sides thereof, a bowstring having its opposite ends each removably mounted under tension at the free end of a different one of said pair of resilient arms, and a trigger mechanism releasably holding said bowstring under tension with said resilient arms flexed removably mounted on the exterior of said hollow tubular body at a point spaced along said elongated tubular body from said plug closing said one end thereof in a plane normal to said plane in which said pair of arms extend, whereby said arms, said bowstring and said trigger mechanism may be removed and received within said sealed container provided by said elongated hollow body and said cap.

2. A survival kit as claimed in claim 1 including an arrow having a length less than said given length of said sealed container provided by said elongated hollow body and said cap.

3. A survival kit as claimed in claim 1 wherein said cap comprises an elongated tubular cup-like member.

4. A survival kit as claimed in claim 3 wherein said length of each of said pair of resilient arms is substantially equal to the length of said hollow elongated tubular body and said hollow elongated tubular body is dimensioned to receive said arms, said trigger mechanism and said bowstring with said elongated tubular cup-like cap means being dimensioned to receive other items of survival equipment.

5. A survival kit as claimed in claim 1 wherein said means removably mounting one end of each of said pair of arms on said solid plug at said one end of said elongated hollow tubular body comprises external threads on said one end of each of said pair of resilient arms and a threaded passageway through said solid plug closing said one end of said elongated hollow tubular body.

6. A survival kit as claimed in claim 5 wherein said elongated hollow tubular body and said solid plug closing said one end thereof are integral with each other and together with said cap, said pair of resilient arms and said trigger mechanism are made of aluminum.

7. A collapsible cross-bow comprising an elongated body of given length, a pair of resilient arms each having a length less than said given length and each provided with an externally threaded portion of circular cross-section at one end thereof, a tapped passageway of circular-cross section through said elongated body at one end thereof threadedly engaging said externally threaded portions of each of said arms at opposite ends thereof, a bowstring having its opposite ends each removably mounted under tension at the free end of a different one of said pair of resilient arms, and a trigger mechanism releasably holding said bowstring under tension with said resilient arms flexed removably mounted on the external surface of said elongated body at a point spaced along said body from said tapped passageway in a plane normal to the axis of said tapped passageway.

8. A collapsible cross-bow as claimed in claim 7 wherein said elongated body is provided with a semicircular channel extending along the exterior surface thereof from said trigger mechanism to the end of said elongated body with the axis thereof parallel to the axis of elongation of said elongated member and perpendicular to but spaced from said axis of said tapped passageway.

9. A collapsible cross-bow as claimed in claim 8 wherein said elongated body is a hollow tubular body closed at said one end by a solid portion and removably sealed water-tight at the other end by a cap to form a sealed container dimensioned to receive said pair of resilient arms, said bowstring and said trigger mechanism.

10. A cross-bow as claimed in claim 7 comprising a bracket having a pair of spaced upstanding walls a first pin extending transversely between said upstanding walls at one end thereof, a rolling block comprising an axially apertured right circular cylinder mounted on said pin for rotation thereabout said cylinder having a pair of diametrically opposed notches in the exterior surface thereof, a second pin extending transversely between said upstanding walls, and an elongated trigger lever mounted between its ends on said second pin for pivotal movement thereabout, the length of said trigger lever and the spacing between said pins being selected to enable one end of said trigger lever to be pivoted into blocking engagement with one of said notches in the exterior of said cylinder to prevent rotation of said cylinder in one direction and to be pivoted out of said blocking engagement with said one of said notches in the exterior of said cylinder by the application of force to the other end of said lever to permit rotation of said cylinder in said one direction by a bow-string received under tension in the other of said notches in the exterior surface of said cylinder.

* * * * *